US005755834A

United States Patent [19]

Chandler

[11] Patent Number: 5,755,834

[45] Date of Patent: May 26, 1998

[54] LOW TEMPERATURE ENHANCED DISTILLATE FUELS

[75] Inventor: John E. Chandler, Edison, N.J.

[73] Assignee: Exxon Chemical Patents Inc., Linden, N.J.

[21] Appl. No.: 754,720

[22] Filed: Nov. 21, 1996

Related U.S. Application Data

[63] Continuation of Ser. No. 608,991, Mar. 6, 1996, abandoned.

[51] Int. Cl.[6] ..... C10L 1/18; C10L 1/22

[52] U.S. Cl. ..... 44/386; 44/394; 44/408; 44/419; 44/450

[58] Field of Search ..... 44/386, 408, 394

[56] References Cited

U.S. PATENT DOCUMENTS

| | | | |
|---|---|---|---|
| 3,578,422 | 5/1971 | Dorer, Jr. | 44/386 |
| 4,211,534 | 7/1980 | Feldman | 44/394 |
| 4,375,973 | 3/1983 | Rossi et al. | 44/459 |
| 4,481,013 | 11/1984 | Tack et al. | 44/394 |
| 4,537,602 | 8/1985 | Rossi et al. | 44/408 |
| 4,569,679 | 2/1986 | Rossi | 44/394 |

*Primary Examiner*—Ellen M. McAvoy

*Attorney, Agent, or Firm*—Ohlandt, Greeley, Ruggiero & Perle

[57] ABSTRACT

The invention is directed to a method of enhancing the low temperature flow properties of fuels comprising adding to the fuel a heated additive concentrate comprising: (A) at least one nitrogen-containing derivative of carboxylic acid, (B) an organic acid, and (C) at least one other flow improver, wherein the concentrate is heated to at least about 35° C.

18 Claims, No Drawings

LOW TEMPERATURE ENHANCED DISTILLATE FUELS

This is a continuation of application Ser. No. 608,991, filed Mar. 6, 1996, now abandoned, which is a Rule 62 Continuation of Ser. No. 333,667 filed Nov. 3, 1994, now abandoned.

FIELD OF THE INVENTION

This invention relates to a method of enhancing the low temperature performance of fuels containing concentrates, which concentrates comprise nitrogen-containing derivatives of a carboxylic acid as a wax crystal modifier, an organic acid, and at least one other flow improver.

BACKGROUND OF THE INVENTION

Low temperature operability additive concentrates are added to distillate fuels to improve their flow and filterability properties. Operability additive concentrates comprising amide or amine salts, and an oil soluble compatibility improving organic acid, are described in U.S. Pat. No. 4,537,602, incorporated herein by reference. U.S. Pat. No. 4,537,602 also describes heat soaking the additive concentrate before storage, but fails to disclose any attendant benefits from heating the concentrate after storage and prior to addition to the fuel.

Additionally, U.S. Pat. No. 4,569,679, incorporated herein by reference, discloses that nitrogen-containing derivatives of carboxylic acids are effective in inhibiting wax crystal growth and as a cold flow improving additive when used in combination with an ethylene-unsaturated ester copolymer. However, as described in the specification of U.S. Pat. No. 4,569,679, these additive concentrates have low solubilities and tend to crystallize at ambient temperatures, thus, rendering the concentrate difficult to use. The patent also discloses incorporating a compatibility improving agent into the additive concentrate as a solution to the solubility problem. The compatibilizing agent described in the U.S. Pat. No. 4,569,679 patent is an oil soluble acidic compound comprising oil soluble organic acids including anhydrides.

It is also known in the cold flow improver art to heat and/or dilute certain cold flow additive concentrates (e.g. ethylene-unsaturated ester copolymer concentrates) that form gels or solids on storage especially in cold environments. Heating said additives or adding amounts of solvent or diluent oil keep the concentrate fluid so it can be easily poured and handled. However, where such additive concentrates are already liquid, heating or further dilution would normally not be required.

However, applicant has discovered that the operability performance of fuels containing the low temperature flow improver concentrate described below can be further enhanced by heating the concentrate prior to addition to the fuel.

SUMMARY OF THE INVENTION

The invention is directed to a method of enhancing the low temperature flow properties of fuels comprising adding to the fuel a heated additive concentrate comprising: (A) at least one nitrogen-containing derivative of carboxylic acid, (B) an organic acid, and (C) at least one other flow improver, wherein the concentrate is heated to at least about 35° C. The invention also concerns fuel compositions containing a major amount of fuel and a minor amount of the additive concentrate formed and heated as described above.

The present invention, therefore, is based on a discovery that the fluidity and filterability of fuels containing an additive comprising nitrogen-containing derivatives of carboxylic acid, an organic acid, and at least one other flow improver can be enhanced by heating the additive concentrate before addition to the fuel at temperatures of at least about 35° C., preferably above about 40° C., and more desirably above about 50° C.

DETAILED DESCRIPTION OF THE INVENTION

Concentrates may be prepared as described in U.S. Pat. No. 4,569,679 by combining: (A) one part by weight of the oil-soluble nitrogen-containing compound which may be amides and/or amine salts of carboxylic acids or ammonium salts of said acids or anhydrides thereof; (B) 0.005 to 1.0, e.g. 0.01 to 0.7, preferably 0.02 to 0.5, parts by weight of an oil-soluble acidic compound which acts as a compatibility improver agent; and (C) about 0.01 to 10, e.g. 0.03 to 5, preferably 0.05 to 5, parts by weight of each other flow improver additive. Concentrates in a mineral oil as a solvent and/or diluent, such as naphtha, of 5 to 80, preferably 15 to 70 wt. % of the additive combination (A), (B) and (C) will generally be used. Aromatic solvents or aromatic containing oils, such as heavy aromatic naphtha (HAN), are particularly suitable for dissolving the aforesaid components to make concentrates. The benefits derived from heating the additive concentrate were observed whether the concentrate was previously diluted with a solvent or diluent or not.

The preheated flow improver concentrates used in the present invention may be incorporated into a broad category of petroleum fuel oils, especially distillate fuels boiling in the range of about 120° C. to about 500° C. (ASTM D-86), preferably those distillate fuels boiling in the range of about 150° C.–400° C. The most common petroleum distillate fuels are kerosene, jet fuels, diesel fuels and heating oils. Low temperature flow properties are most usually encountered with diesel fuels and with heating oils.

The concentrates will generally be included in the fuel to give a total additive concentration of (A), (B) and (C) in the fuel of about 0.001 to 0.5 wt. %. Excellent results are usually achieved with said total additive concentrations in the range of about 0.005 to about 0.25 wt. %, preferably in the range of about 0.005 to about 0.1 wt. %, where said weight percents are based upon the weight of distillate fuel.

The Nitrogen-Containing Compound

Nitrogen compounds effective in keeping the wax crystals separate from each other, i.e. by inhibiting agglomeration of wax crystals, are used as a component of the additive mixtures. These compounds include oil soluble amine salts and/or amides, which generally form by reaction of at least one molar proportion of hydrocarbyl substituted amines with a molar proportion of hydrocarbyl acid having 1 to 4 carboxylic acid groups, or their anhydrides.

In the case of polycarboxylic acids, or anhydrides thereof, all acid groups may be converted to amine salts or amides, or part of the acid groups may be converted to esters by reaction with hydrocarbyl alcohols, or part of the acid groups may be left unreacted.

The hydrocarbyl groups of the preceding amine, carboxylic acid or anhydride, and alcohol compounds include groups which may be straight or branched chain, saturated or unsaturated, aliphatic, cycloaliphatic, aryl, alkaryl, etc. Said hydrocarbyl groups may contain other groups, or atoms, e.g. hydroxy groups, carbonyl groups, ester groups, or oxygen, or sulfur, or chlorine atoms, etc. These hydrocarbyl groups will usually be long chain, e.g., $C_{12}$ to $C_{40}$, e.g. $C_{14}$ to $C_{24}$. However, some short chains, e.g. $C_1$ to $C_{11}$ may be included as long as the total numbers of carbons is sufficient for solubility. Thus, the resulting compound should contain a sufficient hydrocarbon content so as to be oil soluble and it will therefore normally contain in the range of about 30 to 300, e.g. 36 to 160, total carbon atoms. The number of carbon atoms necessary to confer oil solubility will vary with the degree of polarity of the compound. In general, about 36 or more carbons are preferred for each amide linkage that is present in the compound, while for the more polar amine salts about 72 carbons or more are preferred for each amine salt group. The compound will preferably also have at least one straight chain alkyl segment extending from the compound containing 8 to 40, e.g. 12 to 30 carbon atoms. This straight chain alkyl segment may be in one or several of the amine or ammonium ion, or in the acid, or in the alcohol (if an ester group is also present). At least one ammonium salt, or amine salt, or amide linkage is required to be present in the molecule.

The amines may be primary, secondary, tertiary or quaternary, but preferably are secondary. If amides are to be made, then primary or secondary amines will be used.

Examples of primary amines include n-dodecyl amine, n-tridecyl amine, $C_{13}$ Oxo amine, coco amine, tallow amine, behenyl amine, etc. Examples of secondary amines include methyl-lauryl amine, dodecyl-octyl amine, coco-methyl amine, tallow-methylamine, methyl-n-octyl amine, methyl-n-dodecyl amine, methyl-behenyl amine, ditallow amine etc. Examples of tertiary amines include coco-diethyl amine, cyclohexyl-diethyl amine, coco-dimethyl amine, tri-n-octyl amine, di-methyl-dodecyl amine, methyl-ethyl-coco amine, methyl cetyl stearyl amine, etc. Examples of quaternary amino bases or salts include dimethyl dicetyl amino base, di-methyl distearyl amino chloride, etc.

Amine mixtures may also be used and many amines derived from natural materials are mixtures. Thus, coco amine derived from coconut oil is a mixture of primary amines with straight chain alkyl groups ranging from $C_8$ to $C_{18}$. Another example is tallow amine, derived from hydrogenated tallow, which amine is a mixture of $C_{14}$ to $C_{18}$ straight chain alkyl groups. Tallow amine is particularly preferred.

Examples of the carboxylic acids or anhydrides, include formic, acetic, hexanoic, lauric, myristic, palmitic, hydroxy stearic, behenic, naphthenic, salicyclic, acrylic, linoleic, dilinoleic, trilinoleic, maleic, maleic anhydride, fumaric, succinic, succinic anhydride, alkenyl succinic anhydride, adipic, glutaric, sebacic, lactic, malic, malonic, citraconic, phthalic acids (o, m, or p), e.g. terephthalic, phthalic anhydride, citric, gluconic, tartaric, 9,10-di-hydroxystearic, etc.

Specific examples of alcohols include 1-tetradecanol, 1-hexadecanol, 1-octadecanol, $C_{12}$ to $C_{18}$ Oxo alcohols made from a mixture of cracked wax olefins, 1-hexadecanol, 1-octadecanol, behenyl alcohol, 1,2-dihydroxy octadecane, 1,10-dihydroxydecane, etc.

The amides can be formed in a conventional manner by heating a primary or secondary amine with acid, or acid anhydride. Similarly, the ester is prepared in a conventional manner by heating the alcohol and the polycarboxylic acid to partially esterify the acid or anhydride (so that one or more carboxylic groups remain for the reaction with the amine to form the amide or amine salt). The ammonium salts are also conventionally prepared by simply mixing the amine (or ammonium hydroxide) with the acid or acid anhydride, or the partial ester of a polycarboxylic acid, or partial amide of a polycarboxylic acid, with stirring, generally with mild heating (e.g. 700°–80° C.).

Particularly preferred are nitrogen compounds of the above type that are prepared from dicarboxylic acids, optimally the aliphatic dicarboxylic acids. Mixed amine salts/amides are most preferred, and these can be prepared by heating maleic anhydride, or alkenyl succinic anhydride with a secondary amine, preferably tallow amine, at a mild temperature, e.g. 80° C. without the removal of water.

The Compatibility Improver

The acidic compound for use in the concentrates of the present invention are organic acids, including their anhydrides, particular acids containing 3 to 100, e.g. 6 to 30, preferably 6 to 24, carbons and having 1 to 3, preferably 1 to 2, acid groups. While their method of operation is not fully understood, it is believed that they improve the solubility of the nitrogen compound and may inhibit the interaction of the basic nitrogen compound with the other flow improver, e.g. ethylene-unsaturated ester copolymer to hinder gelling or undue viscosity increase of the oil. The choice of the acid may depend upon the nature of the nitrogen compound and the particular other flow improver of the concentrate. Suitable organic acids include carboxylic acids, aromatic carboxylic acids being especially useful, sulfonic acids such as alkaryl sulfonic acids and phenols. Examples of suitable acids include non-linear carboxylic acids which may be aromatic, aliphatic, branched or unbranched, saturated or unsaturated, substituted or unsubstituted. Aromatic carboxylic acids appear especially useful as are phenols and phosphorus acids. Preferred are weak acids such as fatty acids, benzoic acid, phenol, alkyl phenols, dicarboxylic acids such as maleic anhydride, alkenyl or alkyl succinic acid or anhydride, organic phosphates such as dialkyl, mono acid phosphate, etc.

Other Flow Improvers

Preferred other known flow improver additives used in accordance with this invention are selected from the group described below.

(i) Comb Polymers

Comb polymers are polymers in which hydrocarbyl groups are pendant from a polymer backbone and are discussed in "Comb-Like Polymers. Structure and Properties", N. A. Platé and V. P. Shibaev, J. Poly. Sci. Macromolecular Revs., 8, pages 117 to 253 (1974).

Advantageously, the comb polymer is a homopolymer having side chains containing at least 6, and preferably at least 10, carbon atoms or a copolymer having at least 25 and preferably at least 40, more preferably at least 50, molar per cent of units having side chains containing at least 6, and preferably at least 10, carbon atoms.

As examples of preferred comb polymers there may be mentioned those of the general formula

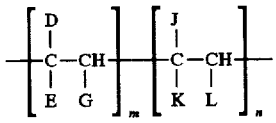

where

D=$R^{11}$, $COOR^{11}$, $OCOR^{11}$, $R^{12}COOR^{11}$ or $OR^{11}$

E=H, $CH_3$, D or $R^{12}$

G=H or D

J=H, $R^{12}$, $R^{12}$, $COOR^{11}$, or an aryl or heterocyclic group

K=H, $COOR^{12}$, $OCOR^{12}$, $OR^{12}$ or COOH

L=H, $R^{12}$, $COOR^{12}$, $OCOR^{12}$ or aryl $R^{11} \geqq C_{10}$ hydrocarbyl $R^{12} \leqq C_1$ hydrocarbyl and m and n represent mole ratios, m being within the range of from 1.0 to 0.4, n being in the range of from 0 to 0.6. $R^{11}$ advantageously represents a hydrocarbyl group with from 10 to 30 carbon atoms, and $R^{12}$ advantageously represents a hydrocarbyl group with from 1 and 30 carbon toms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g. an α-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such as for example those described in European Patent Applications 153 176, 153 177 and 225 688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred fumarate comb polymers may, for example, have a number average molecular weight in the range of 1,000 to 100,000, preferably 1,000 to 30,000, as measured by Vapour Phase Osmometry (VPO).

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous.

(ii) Polyoxyalkylene Compounds

Examples are polyoxyalkylene esters, ethers, ester/ethers and mixtures thereof, particularly those containing at least one, preferably at least two $C_{10}$ to $C_{30}$ linear saturated alkyl groups and a polyoxyalkylene glycol group of molecular weight up to 5,000 preferably 200 to 5,000, the alkyl group in said polyoxyalkylene glycol containing from 1 to 4 carbon atoms. These materials form the subject of European Patent Publication 0 061 895 A2. Other such additives are described in U.S. Pat. No. 4,491,455.

The preferred esters, ethers or ester/ethers which may be used may be structurally depicted by the formula $$R^6—O(A)—O—R^7$$

where $R^6$ and $R^7$ are the same or different and may be (a) n-alkyl (b) n-alkyl-$\overset{\overset{\displaystyle O}{\|}}{C}$ (c) n-alkyl-O—$\overset{\overset{\displaystyle O}{\|}}{C}$—$(CH_2)_n$—

(d) n-alkyl-O—$\overset{\overset{\displaystyle O}{\|}}{C}$—$(CH_2)_n$—$\overset{\overset{\displaystyle O}{\|}}{C}$— n being, for example, 1 to 30, the alkyl group being linear and saturated and containing 10 to 30 carbon atoms, and A representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. A may also contain nitrogen.

Examples of suitable glycols are substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives, it being preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates when minor amounts of monoethers and monoesters (which are often formed in the manufacturing process) may also be present. It is important for additive performance that a major amount of the dialkyl compound is present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication No.'s 2-51477 and 3-34790 (both Sanyo), and the esterified alkoxylated amines described in EP-A-117,108 and EP-A-326,356 (both Nippon Oil and Fats).

(iii) Ethylene/Unsaturated Ester Copolymers

The ethylene copolymers are the type known in the art as wax crystal modifiers, e.g. pour depressants and cold flow improvers for distillate fuel oils. Usually, they will comprise about 3 to 40, preferably 4 to 20, molar proportions of ethylene per molar proportion of ethylenically unsaturated ester monomer, which latter monomer can be a single monomer or a mixture of such monomers in any proportion. These polymers will generally have a number average molecular weight in the range of about 500 to 50,000, preferably about 1000 to 20,000, e.g. 1000 to 6000, as measured for example by Vapor Pressure Osmometry (VPO), such as using a Mechrolab Vapor Pressure Osmometer Model 302B.

The unsaturated monomers, copolymerizable with ethylene, include unsaturated mono and diesters of the general formula:

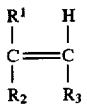

wherein $R_1$ is hydrogen or methyl; $R_2$ is a —$OOCR_4$ or —$COOR_4$ group wherein $R_4$ is hydrogen or a $C_1$ to $C_{28}$, more usually $C_1$ to $C_{16}$ and preferably a $C_1$ to $C_8$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_1$ to $C_{29}$, more usually $C_1$ to $C_{17}$, monocarboxylic acid, and preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$ and R3 is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and either or both of $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate, di-lauryl fumarate, ethyl methyl fumarate, etc. It is preferred, however, that the acid groups be completely esterified as free acid groups tend to promote haze if moisture is present in the oil.

Copolymers of ethylene and unsaturated esters, and methods for their manufacture, are well known in the art of distillate flow improvers and have been described in numerous patents such as U.S. Pat. Nos. 4,211,534; 3,961,916; and 4,087,255. Copolymers of ethylene and vinyl acetate are particularly preferred.

Oil-soluble, as used herein, means that the additives are soluble in the fuel at ambient temperatures, e.g., at least to the extent of about 0.01 wt. % additive in the fuel oil at 25° C., although at least some of the additive comes out of solution near the cloud point in order to modify the wax crystals that form.

(iv) Hydrocarbon Polymers

Examples are those represented by the following general formula

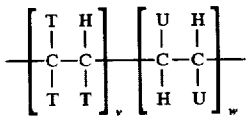

where

T=H or R'

U=H, T or aryl

R'=$C_1$–$C_{30}$ hydrocarbyl and v and w represent mole ratios, v being within the range 1.0 to 0.0, w being within the range 0.0 to 1.0.

These polymers may be made directly from ethylenically unsaturated monomers or indirectly by hydrogenating the polymer made from monomers such as isoprene and butadiene.

Preferred hydrocarbon polymers are copolymers of ethylene and at least one α-olefin, having a number average molecular weight of at least 30,000. Preferably the α-olefin has at most 20 carbon atoms. Examples of such olefins are propylene, 1-butene, isobutene, n-octene-1, isooctene-1, n-decene-1, and n-dodecene-1. The copolymer may also comprise small amounts, e.g. up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is, as indicated above, at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. Advantageously, the polymers are substantially amorphous, since highly crystalline polymers are relatively insoluble in fuel oil at low temperatures.

The additive composition may also comprise a further ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent although for ethylene-propylene copolymers up to 86 molar per cent by weight ethylene may be employed with advantage.

Examples of hydrocarbon polymers are described in WO-A-9 111 488.

(v) Sulphur Carboxy Compounds

Examples are those described in EP-A0,261,957 which describes the use of compounds of the general formula

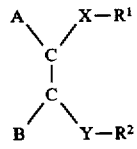

in which —Y—$R^2$ is $SO_3^{(-)(+)}NR_3^3R^2$, —$SO_3^{(-)(+)}HNR_2^3R^2$,

—$SO_3^{(-)(+)}H_2NR^3R^2$, —$SO_3^{(-)(+)}H_3NR^2$, $—SO_2NR^3R^2$ or $—SO_3R^2$;

$—X—R^1$ is $—Y—R^2$ or $—CONR^3R^1$, $—CO_2^{(-)(+)}NR_3^3R^1$, $—CO_2^{(-)(+)}HNR_2^3R^1$, $—R^4—COOR_1$, $—NR^3COR^1$, $—R_4OR^1$, $—R^4OCOR^1$, $—R^4.R^1$, $—N(COR^3)R^1$ or $Z^{(-)(+)}NR_3^3R^1$;

$—Z^{(-)}$ is $SO_3^{(-)}$ or $—CO_2^{(-)}$;

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

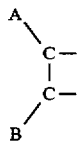

the carbon-carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that $X—R^1$ and $Y—R^2$ between them contain at least three alkyl, alkoxyalkyl or polyalkoxyalkyl groups.

(vi) Hydrocarbylated-Aromatics

These materials are condensates comprising aromatic and hydrocarbyl parts. The aromatic part is conveniently an aromatic hydrocarbon which may be unsubstituted or substituted with, for example, non-hydrocarbon substituents.

Such aromatic hydrocarbon preferably contains a maximum of these substituent groups and/or three condensed rings, and is preferably naphthalene. The hydrocarbyl part is a hydrogen and carbon containing part connected to the rest of the molecule by a carbon atom. It may be saturated or unsaturated, and straight or branched, and may contain one or more hetero-atoms provided they do not substantially affect the hydrocarbyl nature of the part. Preferably the hydrocarbyl part is an alkyl part, conveniently having more than 8 carbon atoms. The molecular weight of such condensates may, for example, be in the range of 2,000 to 200,000 such as 2,000 to 20,000, preferably 2,000 to 8,000.

Examples are known in the art, primarily as lube oil pour depressants and as dewaxing aids as mentioned hereinbefore, they may, for example, be made by condensing a halogenated wax with an aromatic hydrocarbon. More specifically, the condensation may be a Friedel-Crafts condensation where the halogenated wax contains 15 to 60, e.g. 16 to 50, carbon atoms, has a melting point of about 200° to 400° C. and has been chlorinated to 5 to 25 wt. % chlorine, e.g. 10 to 18 wt. %.

Another way of making similar condensates may be from olefins and the aromatic hydrocarbons.

Multicomponent additive systems may be used and the ratios of additives to be used will depend on the fuel to be treated.

The concentrates may also contain waxes such as normal paraffin waxes, slack waxes, foots oil and other waxes as described in col. 4, line 39 to col. 5, line 16 and col. 11, line 45 to col. 12, line 6 of U.S. Pat. No. 4,210,424; as well as other conventional additives found useful in treating fuel oil.

The following examples demonstrate the beneficial effect of heating the additive concentrate as described herein prior to addition to the fuel. Diesel fuels used in the following examples have the following characteristics:

DISTILLATION PROFILE OF FUELS (ASTM-D86)

| | Cloud Point °C. | Initial Boiling Point °C. | 20° C. | 50° C. | 90° C. | Final Boiling Point °C. |
|---|---|---|---|---|---|---|
| Fuel 1 | −13.6 | 192 | 231 | 263 | 319 | 349 |
| Fuel 2 | −12.6 | 183 | 234 | 271 | 322 | 351 |

The effectiveness of heating the concentrate before addition to the fuel to increase the fluidity and filterability of the fuel was determined by the Low Temperature Flow Test (ASTM-D4539-91).

Briefly in this test the temperature of samples containing the heated concentrate in the test fuel is lowered at a controlled cooling rate. Commencing at a desired test temperature and at each 1° C. interval thereafter, a separate sample from the series is filtered through a 17-μm screen until a minimum LTFT pass temperature is obtained. The minimum LTFT pass temperature is the lowest temperature, expressed as a multiple of 1° C., at which a minimum of 180 mL of sample, when cooled under the prescribed conditions, can be filtered in 60 seconds or less.

Alternatively, a single sample may be cooled as described above and tested at a specified temperature to determine whether it passes or fails at that temperature.

EXAMPLE 1

Concentrates for use in the fuels described above were prepared by stirring a mixture of the additive components, an organic compound (nonyl phenol), and heavy aromatic naphtha at from 50° to 60° C. for 1 hour. The concentrate components comprised 4 parts by weight of amide/dialkyl ammonium salt from the reaction product of 1 mole phthalic anhydride with 2 moles of a secondary dihydrogenated tallow amine containing a mixture of tallow fat n-alkyl groups (Note: The reaction product can be made in the presence of the organic compound or the organic compound can be post added.) and 1 part by weight of an ethylene vinyl acetate copolymer having a VA content of 13.5% and a molecular weight of 3400.

The resulting concentrate was heated and then added to Fuel 1. The LTFT was then determined as described above and the results obtained shown in Table I below.

TABLE I

| Concentrate Treat Rate (ppm) | Pre Heat Temperature | Lowest Recorded LTFT Pass Results, °C. |
|---|---|---|
| 1250 | <35° C.* | −18° C. |
| 1250 | 40° C. | ≦−24 |
| 1250 | 50° C. | ≦−24 |

*The temperature was between room temperature (25° C.) and less than 35° C.

In the above LTFT results < means the minimum LTFT temperature as defined above was not attained, thus an even lower LTFT pass temperature was possible.

EXAMPLE 2

Fuel 2 alone or blended with various amounts of kerosene were treated with the additive concentrate as described in Example 1. The samples were preheated before addition to the blends and the LTFT was determined as described above. The results are shown in Table II below.

TABLE II

| Blend Fuel/Kerosene | Concentrate Treat Rate (ppm) | Pre Heat Temperature (40–50° C.) | Lowest Recorded LTFT Pass, °C. |
|---|---|---|---|
| 100/0 | 1000 | No | >−14 |
| 100/0 | 1000 | Yes | >−14 |
| 80/20 | 1000 | No | −19 |
| 80/20 | 1000 | Yes | −20 |
| 70/30 | 1000 | No | −25 |
| 70/30 | 1000 | Yes | −28 |
| 60/40 | 1000 | No | −27 |
| 60/40 | 1000 | Yes | <−30 |
| 100/0 | 1250 | No | >−15 |
| 100/0 | 1250 | Yes | −20 |

As shown in Tables I and II, heating the additive concentrate prior to addition to the fuels as disclosed herein improved the cold flow filterability and fluidity of the treated fuels. In the LTFT results shown > means that the minimum LTFT temperature is higher than the recorded temperature, and < means that the minimum LTFT temperature is lower than the recorded temperature.

What is claimed is:

1. A method of enhancing the low temperature fluidity and filterability properties of fuels comprising adding to the fuel from about 0.001 to 0.5 wt % of a normally liquid additive concentrate comprising: (A) at least one nitrogen-containing derivative of a carboxylic acid, (B) an organic acid, and (C) at least one other flow improver, wherein the normally liquid concentrate is heated to a heated state of at least about 35° C., the concentrate being in said heated state when added to the fuel.

2. The method of claim 1 wherein the additive concentrate is heated to a heated state of at least about 40° C.

3. The method of claim 2 wherein the additive concentrate is heated to a heated state of at least about 50° C.

4. The method of claim 1 wherein the concentrate contains a mineral oil as a solvent and/or diluent.

5. The method of claim 1 wherein the concentrate contains an ethylene-unsaturated ester copolymer as the other flow improver.

6. The method of claim 5 wherein the ethylene-unsaturated ester copolymer is a ethylene vinyl acetate copolymer.

7. The method of claim 1 wherein the nitrogen-containing compound of the concentrate is an amide/dialkyl ammonium salt obtained by reacting 1 mole of phthalic anhydride with 2 moles of a secondary di(hydrogenated) tallow amine.

8. The method of claim 7 wherein the organic acid of the concentrate is a phenol.

9. The method of claim 8 wherein the other flow improver of the concentrate is an ethylene vinyl acetate copolymer.

10. A fuel composition of enhanced low temperature fluidity and filterability properties comprising a distillate fuel and from about 0.001 to 0.5 wt % of a heated additive concentrate wherein the concentrate comprises: (A) at least one nitrogen-containing derivative of carboxylic acid, (B) an organic acid, and (C) at least one other flow improver, which concentrate having been heated to a heated state of at least about 35° C. before addition to the fuel and being in said heated state when added to the fuel.

11. The composition of claim 10 wherein the additive concentrate has been heated to a heated state of at least about 40° C.

12. The composition of claim 11 wherein the additive concentrate has been heated to a heated state of at least about 50° C.

13. The composition of claim 10 wherein the concentrate contains a mineral oil as a solvent and/or diluent.

14. The composition of claim 10 wherein the concentrate contains an ethylene-unsaturated ester copolymer as the other flow improver.

15. The composition of claim 14 wherein the ethylene-unsaturated ester copolymer is an ethylene vinyl acetate copolymer.

16. The composition of claim 10 wherein the nitrogen-containing compound of the concentrate is an amide/dialkyl ammonium salt obtained by reacting 1 mole of phthalic anhydride with 2 moles of a secondary di(hydrogenated) tallow amine.

17. The composition of claim 16 wherein the organic acid of the concentrate is a phenol.

18. The composition of claim 17 wherein the other flow improver of the concentrate is an ethylene vinyl acetate copolymer.

* * * * *